US011603262B2

(12) United States Patent
Wang

(10) Patent No.: US 11,603,262 B2
(45) Date of Patent: Mar. 14, 2023

(54) INTERNAL SHELTER ARRANGEMENT FOR TRASH CONTAINER

(71) Applicant: Shiping Wang, Ontario, CA (US)

(72) Inventor: Shiping Wang, Ontario, CA (US)

( * ) Notice: Subject to any disclaimer, the term of this patent is extended or adjusted under 35 U.S.C. 154(b) by 84 days.

(21) Appl. No.: 17/100,945

(22) Filed: Nov. 23, 2020

(65) Prior Publication Data

US 2022/0161996 A1 May 26, 2022

(51) Int. Cl.
*B65F 1/06* (2006.01)
*B65F 1/16* (2006.01)

(52) U.S. Cl.
CPC ..... *B65F 1/1623* (2013.01); *B65F 1/1607* (2013.01); *B65F 2001/1676* (2013.01); *B65F 2210/167* (2013.01)

(58) Field of Classification Search
CPC ..... B65F 1/062; B65F 1/1623; B65F 1/1607; B65F 1/16; B65F 2001/1676; B65F 2210/1367; B65F 2210/148; B65F 2240/132
USPC ..... 220/254.3, 260, 495.06, 495.08
See application file for complete search history.

(56) References Cited

FOREIGN PATENT DOCUMENTS

WO WO2021093940 * 5/2021 ..... B65F 1/06

* cited by examiner

*Primary Examiner* — Don M Anderson
*Assistant Examiner* — Elizabeth J Volz
(74) *Attorney, Agent, or Firm* — Raymond Y. Chan; David and Raymond Patent Firm

(57) ABSTRACT

A trash container includes a container body, a cover unit, and an internal shelter arrangement. The container body has a top opening and a trash cavity for receiving a trash object through the top opening. The cover unit includes a cover panel for selectively opening and closing the top opening. The internal shelter arrangement includes a shelter boundary frame detachably coupled between the container body and the cover unit, and a shelter unit movably coupled at the shelter boundary frame to seal a shelter opening of the shelter boundary. When the top opening is opened, the shelter unit is downwardly and pivotally folded to open up the shelter opening in response to an external force of a weight of the trash object for disposing the trash object in the trash cavity.

12 Claims, 7 Drawing Sheets

INTERNAL SHELTER ARRANGEMENT FOR TRASH CONTAINER

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a trash container, and more particularly to an internal shelter arrangement for a trash container, wherein the internal shelter arrangement is arranged to keep an opening of the trash container in a closed condition when a cover panel is actuated at an opened position for preventing any odor releasing from the trash container.

Description of Related Arts

An existing trash container, generally comprises a container body, a lid, and an actuation unit being actuated to operatively move the lid between an opened position and a closed position. For example, the actuation unit can be a foot actuator, wherein when the foot actuator is stepped or pressed by a foot of the user, the lid is moved from the closed position to the opened position. When the stepping force at the foot actuator is released, the lid is moved back to the closed position from the opened position. In another example, the actuation unit can be a touch sensor, wherein when the touch sensor is touched or contacted by a hand of the user, the lid is moved from the closed position to the opened position. Then, the lid is moved back to the closed position from the opened position after a predetermined time. Alternatively, the actuation unit can be a detection sensor, wherein when the detection sensor detects a presence of the user within a detection range of the detection sensor, the lid is moved from the closed position to the opened position, wherein the lid is moved back to the closed position from the opened position after a predetermined time.

A common problem with the trash container is the elimination of waste material and odors emanating from the waste materials. When the lid is closed, the lid can be sealed tight at the opening of the container body to prevent any odor emanating therefrom. However, every time when the lid is opened, odors from the waste materials in the container body will release through the opening thereof. Especially for an induction actuation unit, i.e. the touch senor or the detection sensor, the lid may be accidentally opened by fault. As a result, the existing trash container cannot stop the air pollution.

One method to minimize the odors emanated from the container body is to reduce the opening size of the container body, such that less odor will be released through the size reduced opening of the container body. However, it is inconvenient for the user to throw the waste materials into the container body through the size reduced opening thereof.

Another method is the use of trash bag made of deodorizing material the use of deodorizing agent applied in the trash container, such that the trash bag and/or the deodorizing agent can partially absorb the odors from the waste materials. However, the cost of the trash bag will be increased and the deodorizing power of the trash bag and/or the deodorizing agent are ineffective and limited depending on the waste type and amount of the waste materials.

SUMMARY OF THE PRESENT INVENTION

The invention is advantageous in that it provides an internal shelter arrangement for a trash container, wherein the internal shelter arrangement is arranged to keep an opening of the trash container in a closed condition when a cover panel is actuated at an opened position for preventing any odor releasing from the trash container.

Another advantage of the invention is to provide an internal shelter arrangement for a trash container, wherein the internal shelter arrangement comprises two shelter panels being downwardly folded in response to an external force of a weight of the trash object for disposing the trash object in the trash cavity and being upwardly and automatically folded back to seal a shelter opening for preventing any odor releasing from the trash container through the shelter opening.

Another advantage of the invention is to provide an internal shelter arrangement for a trash container, wherein an opening direction of the cover panel to open up the top opening is opposite to an opening direction of the shelter unit to open the shelter opening, such that the operations of the cover unit and the internal shelter arrangement are not interfere with each other.

Another advantage of the invention is to provide an internal shelter arrangement for a trash container, wherein an opening edge of the shelter opening is sealed by side sealing edges of shelter panels to prevent the odor from releasing through the shelter opening and to retain the shelter panels at their sealing position.

Another advantage of the invention is to provide an internal shelter arrangement for a trash container, wherein the shelter panels are automatically returned to seal at the shelter opening via a retention element.

Another advantage of the invention is to provide an internal shelter arrangement for a trash container, wherein the internal shelter arrangement is detachably coupled at the cover unit by means of magnetic attachment mechanism, such that the internal shelter arrangement is automatically aligned with the cover unit.

Another advantage of the invention is to provide an internal shelter arrangement for a trash container, wherein the internal shelter arrangement is detachably coupled at the cover unit to form an edge receiving channel to receive an opening edge of the container body so as to ensure the stable engagement among the container body, the cover unit, and the internal shelter arrangement.

Another advantage of the invention is to provide an internal shelter arrangement for a trash container, which does not require altering the original structural design of the trash container, so as to minimize the manufacturing cost of the trash container that incorporates the internal shelter arrangement.

Another advantage of the invention is to provide an internal shelter arrangement for a trash container, wherein the internal shelter arrangement is configured to incorporate any existing trash container having the upward folding panel cover.

Another advantage of the invention is to provide an internal shelter arrangement for a trash container, wherein no expensive or complicated structure is required to employ the present invention in order to achieve the above mentioned objectives. Therefore, the present invention successfully provides an economic and efficient solution to provide a sealing means preventing any odor releasing from the trash container especially when the cover panel is folded at the opened position.

Additional advantages and features of the invention will become apparent from the description which follows, and may be realized by means of the instrumentalities and combinations particular point out in the appended claims.

According to the present invention, the foregoing and other objects and advantages are attained by a trash container, comprising:

a container body having a top opening and a trash cavity for receiving a trash object through the top opening;

a cover unit coupled on top of the container body, wherein the cover unit comprises a cover panel pivotally moved between an opened position for opening the top opening and a closed position for closing the top opening; and an internal shelter arrangement, comprising:

a shelter boundary frame detachably coupled between the container body and the cover unit, wherein the shelter boundary frame has a shelter opening aligned with the top opening; and a shelter unit movably coupled at the shelter boundary frame to seal the shelter opening so as to close the top opening when the cover panel is either moved at the opened position or at the closed position, wherein when the cover panel is moved at the opened position, the shelter unit is downwardly and pivotally folded to open up the shelter opening in response to an external force of a weight of the trash object for disposing the trash object in the trash cavity.

In accordance with another aspect of the invention, the present invention comprises an internal shelter arrangement for a trash container which comprises a container body and a cover unit, comprising:

a shelter boundary frame for detachably coupling between the container body and the cover unit, wherein the shelter boundary frame has a shelter opening for aligning with the top opening; and a shelter unit which comprises two shelter panels pivotally coupled at a bottom surface of the shelter boundary frame, wherein the shelter panels are upwardly and pivotally to bias against the bottom surface of the shelter boundary frame for sealing the shelter opening, wherein the shelter panels are downwardly and pivotally folded to open up the shelter opening in response to an external force of a weight of a trash object for disposing the trash object in the container body when the top opening is opened up.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
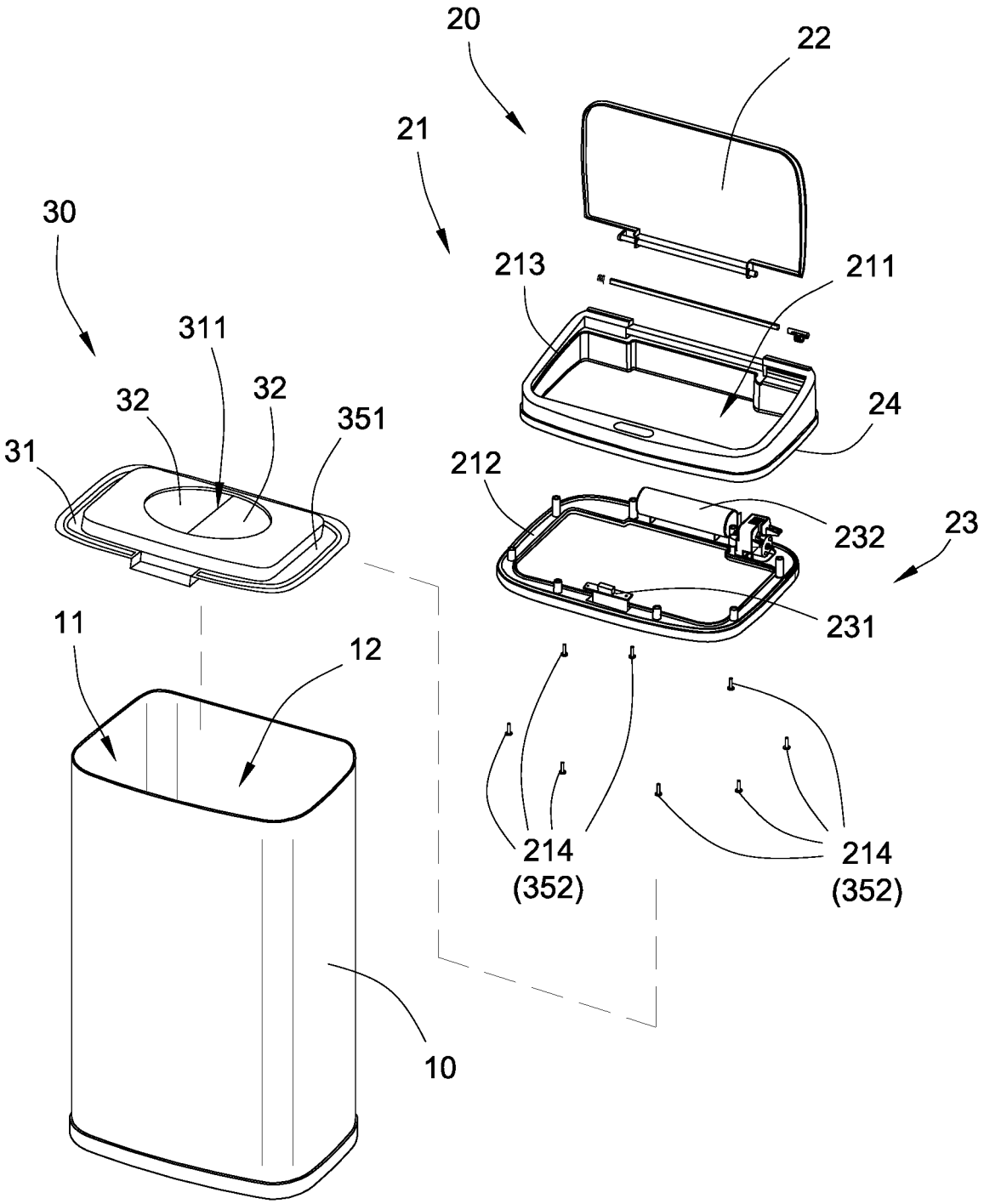
FIG. 1 is an exploded perspective view of a trash container according to a preferred embodiment of the present invention.

Referring to FIG. 1 of the drawings, a trash container according to a preferred embodiment of the present invention, wherein trash container comprises a container unit and an internal shelter arrangement 30. The container unit, such as an existing trash can, comprises a container body 10 and a cover unit 20.

As shown in FIG. 1, the container body 10 has a top opening 11 and a trash cavity 12 communicating with the top opening 11, wherein a user is able to dispose a trash object into the trash cavity 12 of the container body 10 through the top opening 11.

The cover unit 20 is coupled on top of the container body 10, wherein the cover unit 20 comprises a cover housing 21 seated on the container body 10 and a cover panel 22 pivotally coupled at the cover housing 21, wherein the cover panel 22 is pivotally moved between an opened position for opening the top opening 11 and a closed position for closing the top opening 11. Accordingly, the cover housing 21 has a housing cavity 211 located above the top opening 11 of the container body 10, wherein the cover panel 22 is pivotally and downwardly folded to cover at the housing cavity 211 so as to close the top opening 11 at the closed position and is pivotally and upwardly folded to open the housing cavity 211 so as to open up the top opening 11 at the opened position.

According to the preferred embodiment, the cover unit 20 is a hand-free actuation cover unit. In one embodiment, the cover unit 20 is an induction cover unit which comprises an induction actuation unit 23 disposed in the cover housing 21 to actuate the cover panel 22 in response to a presence of the user. The induction actuation unit 23 comprises a sensor 231 coupled at a front portion of the cover housing 21 and an electric motor 232 coupled at a rear portion of the cover housing 21 to couple with the cover panel 22, wherein when the sensor 231 detects a presence of the user within a detecting range, the sensor 231 is configured to send a first activation signal to activate the electric motor 232, such that the cover panel 22 is driven to pivotally move from the closed position to the opened position. After a preset time, the sensor 231 is configured to send a second activation signal to activate the electric motor 232, such that the cover panel 22 is driven to pivotally move back to the closed position from the opened position. It is appreciated that the cover unit 20 can be a foot-operated unit which comprises a foot pedal to pivotally move the cover panel 22 from the closed position to the opened position when the user steps on the foot pedal.

As shown in FIG. 1, the cover housing 21 comprises a bottom housing 212 and an upper housing 213 coupled on the bottom housing 212 to define an operation cavity between the bottom housing 212 and the upper housing 213, wherein induction actuation unit 23 is supported within the operation cavity. Accordingly, the bottom housing 212 and the upper housing 213 are coupled with each other via a plurality of attachment screws 214, wherein the attachment screws 214 are upwardly extended from the bottom housing 212 to the upper housing 213. Preferably, the attachment screws 214 are metal screws having magnetic attracting ability.

Figure 2:
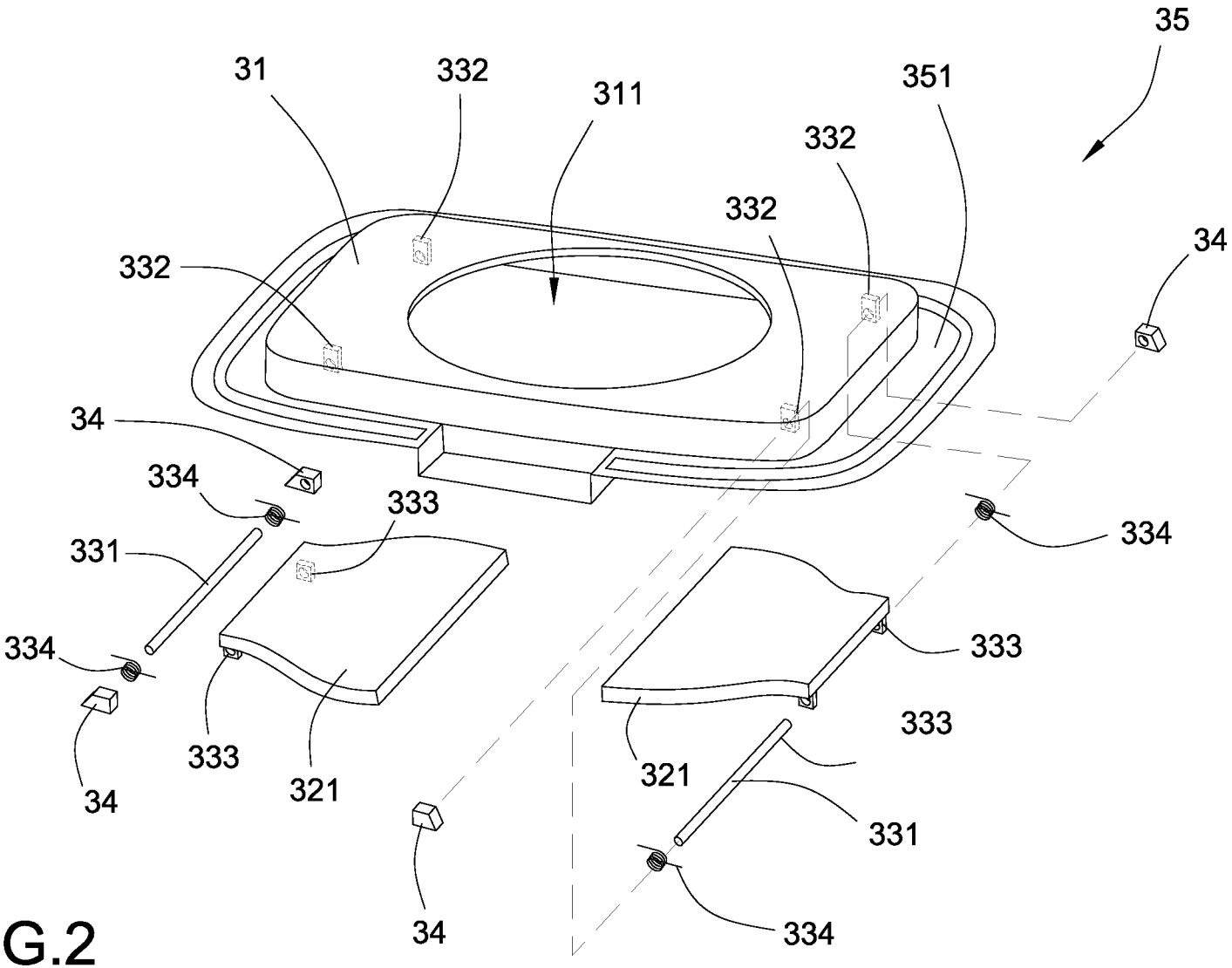
FIG. 2 is an exploded perspective view of an internal shelter arrangement of the trash container according to the above preferred embodiment of the present invention.

As shown in FIGS. 1 and 2, the internal shelter arrangement 30 comprises a shelter boundary frame 31 detachably coupled between the container body 10 and the cover unit 20, and a shelter unit 32 movably coupled at the shelter boundary frame 31 for preventing any odor of the trash object being released from the trash cavity 12 of the container body 10 through the top opening 11.

The shelter boundary frame 31 has a shelter opening 311 aligned with the top opening 11 when the shelter boundary frame 31 is coupled on the container body 10. In other words, when the shelter boundary frame 31 is coupled between the container body 10 and the cover housing 21, the shelter opening 311 is formed between the top opening 11 and the housing cavity 211. Accordingly, the shelter boundary frame 31 has a ring shape supported on an opening edge of the container body 10 to sit at the top opening 11, such that when the shelter opening 311 is closed, the top opening 11 of the container body 10 is sealed even the cover panel 22 is pivotally moved to its opened position.

Figure 3:
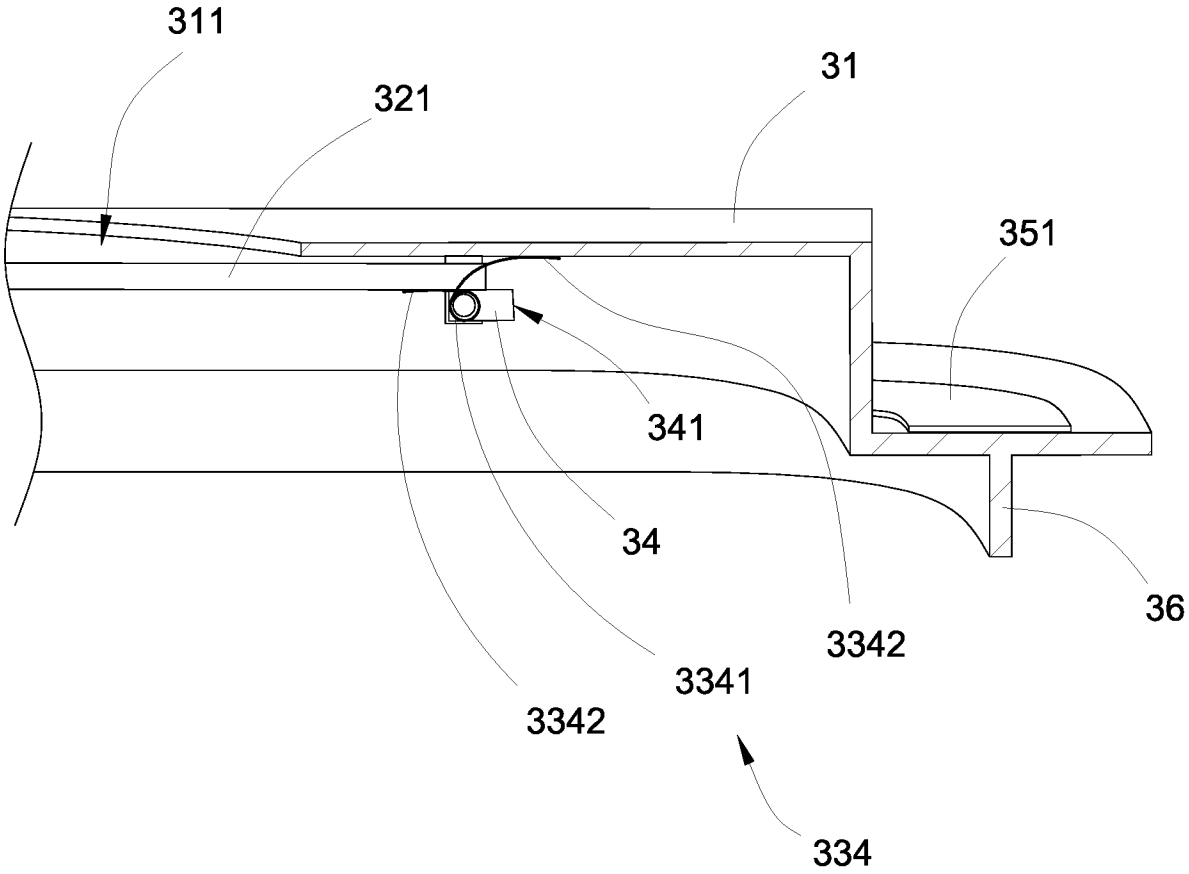
FIG. 3 is a sectional view of the internal shelter arrangement of the trash container according to the above preferred embodiment of the present invention, illustrating the internal shelter arrangement at a sealing position.
Figure 4:
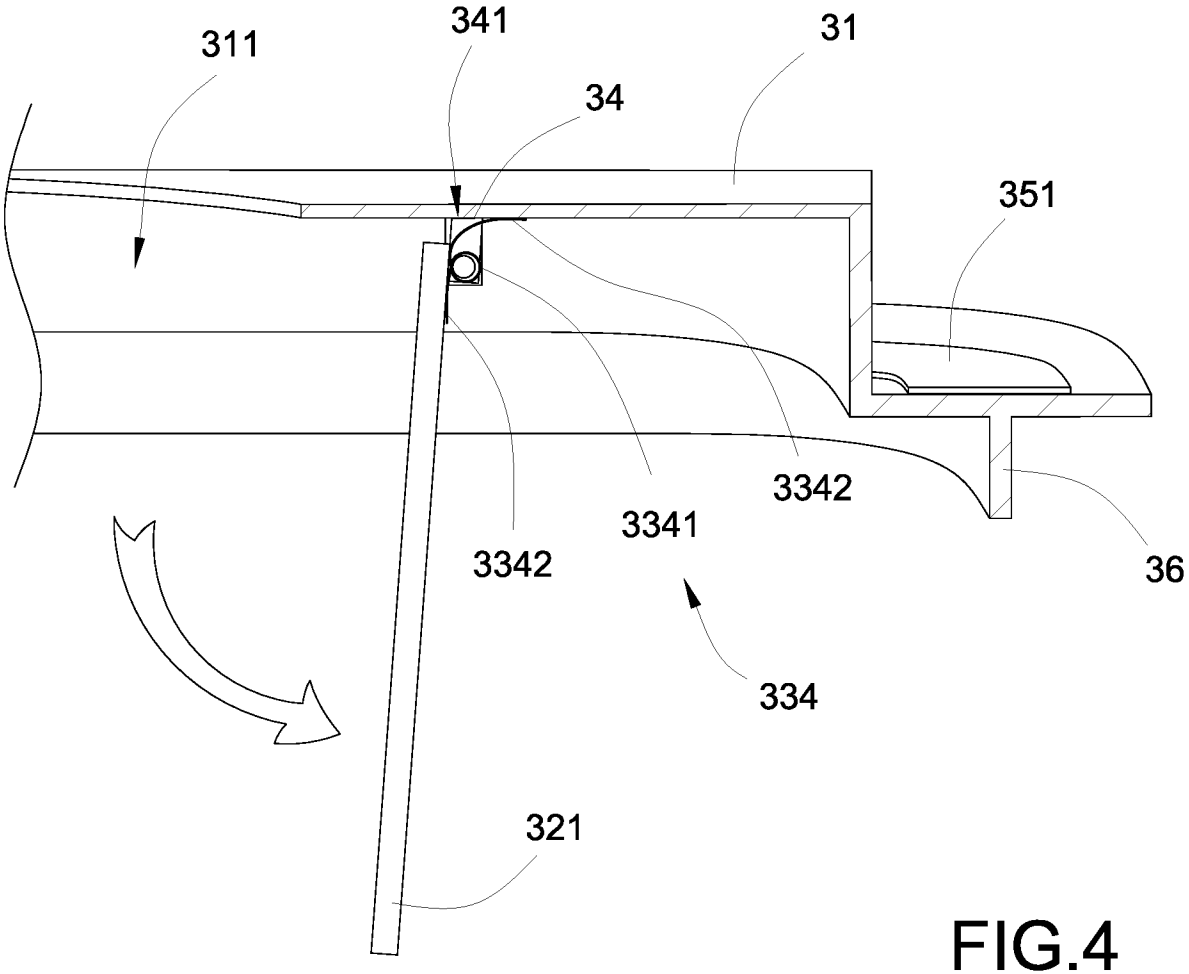
FIG. 4 is a sectional view of the internal shelter arrangement of the trash container according to the above preferred embodiment of the present invention, illustrating the internal shelter arrangement at an unsealing position.

The shelter unit 32 is pivotally coupled at the shelter boundary frame 31 via a pivot joint 33 to move between a sealing position as shown in FIG. 3 and an unsealing position as shown in FIG. 4. At the sealing position, the shelter unit 32 is pivotally moved to seal the shelter opening 311 so as to open up the top opening 11 when the cover panel 22 is either moved at the opened position or at the closed position. At the unsealing position, the shelter unit 32 is pivotally moved to unseal the shelter opening 311 so as to close the top opening 11.

Accordingly an opening direction of the cover panel 22, i.e. the cover panel 22 is moved from the closed position to the opened position, to open up the top opening 11 is opposite to an opening direction of the shelter unit 32, i.e. the shelter unit 32 is moved from the sealing position to the unsealing position, to open the shelter opening 311, such that the operations of the cover unit 20 and the internal shelter arrangement 30 are not interfere with each other. Particularly, the cover panel 22 is pivotally and upwardly moved from the closed position to the opened position to open up the top opening 11. On the other hand, the shelter unit 32 is pivotally and downwardly moved from the sealing position to the unsealing position to open the shelter opening 311. It is worth mentioning that when the cover panel 22 is moved at the opened position, the shelter unit 32 is downwardly and pivotally folded to open up the shelter opening 311 in response to an external force of a weight of the trash object for disposing the trash object in the trash cavity 12 of the container body 10. Therefore, the shelter unit 32 is automatically moved to the unsealing position by applying the external force as a downward gravity force of the trash object on the shelter unit 32.

According to the preferred embodiment, the shelter unit 32 comprises two shelter panels 321 pivotally coupled at a bottom surface of the shelter boundary frame 31, wherein the shelter panels 321 are individually, upwardly and pivotally to bias against the bottom surface of the shelter boundary frame 31 for sealing the shelter opening 311. Therefore, the shelter panels 321 are individually, downwardly and pivotally folded to open up the shelter opening 311 in response to the weight of the trash object for disposing the trash object in the container body 10 when the top opening 11 is opened up. Preferably, the shelter panels 321 are identical in shape and size.

Each of the shelter panels 321 has an inner edge, an outer edge and two sealing side edges. The outer edge of the shelter panels 321 are pivotally coupled at the bottom surface of shelter boundary frame 31. At the sealing position, the inner edges of the shelter panels 321 are aligned side-by-side, while the sealing side edges of the shelter panels 321 are biased against the bottom surface of the shelter boundary frame 31 to close and seal the shelter opening 321. At the unsealing position, the inner edges of the shelter panels 321 are downwardly folded to open up the shelter opening 311.

Preferably, the inner edge of each of the shelter panels 321 has a straight configuration, wherein when the inner edges of the shelter panels 321 are aligned side-by-side, the inner edges of the shelter panels 321 are contacted with each other. It is worth mentioning that the overall area of the shelter panels 321 is larger than an area of the shelter opening 311, such that when the shelter panels 321 are folded at the sealing position, the shelter opening 311 is entirely covered by the shelter panels 321.

Figure 5:
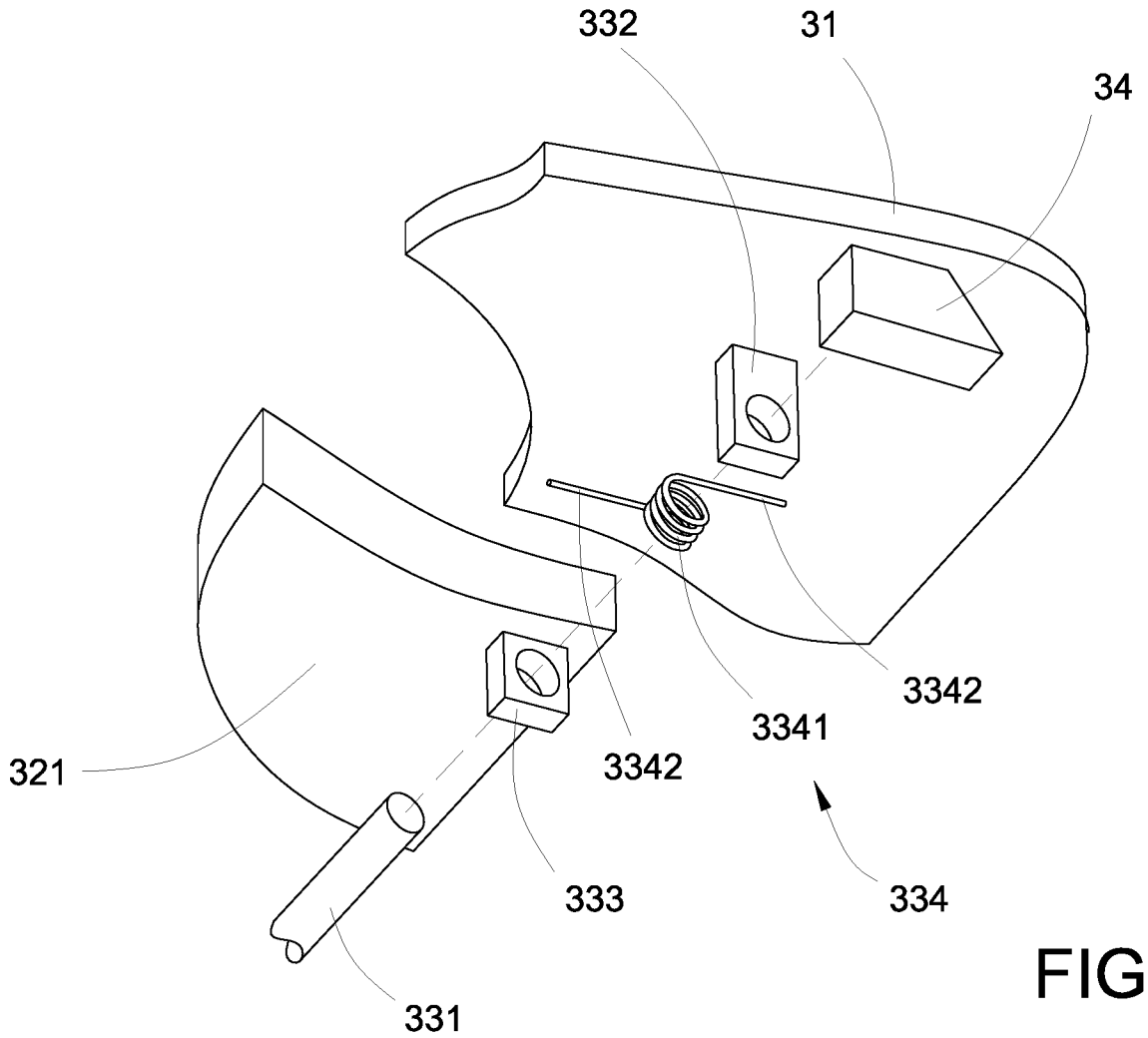
FIG. 5 is an exploded perspective view of a pivot joint of the internal shelter arrangement of the trash container according to the above preferred embodiment of the present invention.

According to the preferred embodiment, the pivot joint 33 comprises one or more pivot shafts 331 rotatably extended between the shelter panel 321 and the shelter boundary frame 31. In one embodiment, the pivot shaft 331 is extended from the outer edge of each of the shelter panels 321 to the shelter boundary frame 31. In other words, at least two pivot joints 33 are provided to pivotally couple the shelter panels 321 to the shelter boundary frame 31. As shown in FIG. 5, each of the pivot joints 33 further comprises a first joint body 332 formed at the shelter boundary frame 31 and a second joint body 333 formed at the shelter panel 321, wherein the pivot shaft 331 is extended between the second joint body 333 and the first joint body 332. In one embodiment, the pivot shaft 331 is affixed at the second joint body 333 to rotatably couple with the first joint body 332 to pivotally couple the shelter panel 321 at the shelter boundary frame 31. It should be appreciated that the pivot shaft 331 can be affixed at the first joint body 332 to rotatably couple with the second joint body 333 to pivotally couple the shelter panel 321 at the shelter boundary frame 31. In one embodiment, two first joint bodies 332 are provided at the outer edge of each of the shelter panels 321 along the sealing side edges thereof respectively. Two second joint bodies 333 are provided at the shelter boundary frame 31 along an opening edge thereof to align with the first joint bodies 332 respectively. One pivot shaft 331 is extended through the first joint bodies 332 to rotatably couple with the second joint bodies 333 to pivotally couple each of the shelter panels 321 at the shelter boundary frame 31. It should be appreciated that two individual pivot shafts 331 are extended through the first joint bodies 332 to rotatably couple with the second joint bodies 333 respectively to pivotally couple each of the shelter panels 321 at the shelter boundary frame 31. It should be appreciated that the two individual pivot shafts 331 can be integrally extended from the first joint bodies 332 to rotatably couple with the second joint bodies 333 respectively.

As shown in FIG. 5, the pivot joint 33 further comprises one or more retention elements 334 provided at the shelter panel 321 to ensure the shelter panel 321 being moved at the sealing position so as to ensure the shelter opening 311 being sealed by the shelter panel 321 when no external force is applied at the shelter panel 321. In other words, the retention elements 334 will move the shelter panels 321 at a position that the inner edges of the shelter panels 321 are aligned side-by-side to seal the shelter opening 321 when no external force is applied at the shelter panel 321.

According to the preferred embodiment, each of the retention elements 334 comprises a resilient element coupled at the pivot shaft 331 to apply a resilient force against the shelter panel 321 so as to push the shelter panel 321 to close the shelter opening 311. Preferably, the resilient element is a coil spring 334 having a coil body 3341 coaxially coupled at the pivot shaft 331 and two coil arms 3342 biasing against the shelter panel 321 and the shelter boundary frame 31. As shown in FIG. 5, the coil arms 3342 are extended from the coil body 3341 in opposite directions, wherein the pivot shaft 331 is slidably extended through the coil body 3341 at a position that the coil body 3341 is positioned between the first joint body 332 and the second joint body 333 so as to retain the retention element 334 in position. When the shelter panel 321 is moved from the sealing position to the unsealing position via the external force is applied at the shelter panel 321, the coil arms 3342 are folded to store the resilient force. Once the external force at the shelter panel 321 is released, i.e. the trash object is disposed in the trash cavity 12, the retention element 334 will restore its original form to push the shelter panel 321 back to the sealing position from the unsealing position. Preferably four retention elements 334 are provided that each of the shelter panels 321 is pushed by two retention elements 334 at the outer edge of the shelter panel 321 along the sealing side edges thereof, such that the resilient forces from the retention elements 334 can be evenly applied to the shelter panel 321 in a balancing manner.

The internal shelter arrangement 30 further comprises a positioning member 34 provided at each of the shelter panels 321 for limiting a downward folding movement of the shelter panels 321. In one embodiment, the positioning member 34 is coupled at a free end of the pivot shaft 331, wherein the positioning member 34 has a blocking surface 341, such that when the pivot shaft 331 is rotated to pivotally move the shelter panel 321 from the sealing position to the unsealing position, the positioning member 34 is driven to rotate until the blocking surface 341 of the position member 34 is biased against the bottom surface of the shelter boundary frame 31 so as to retain the shelter panel 321 at the unsealing position. In other words, the shelter panel 321 cannot be further pivotally moved when the shelter panel 321 is moved at the unsealing position so as to block a further pivot movement of the shelter panel 321.

Figure 6:
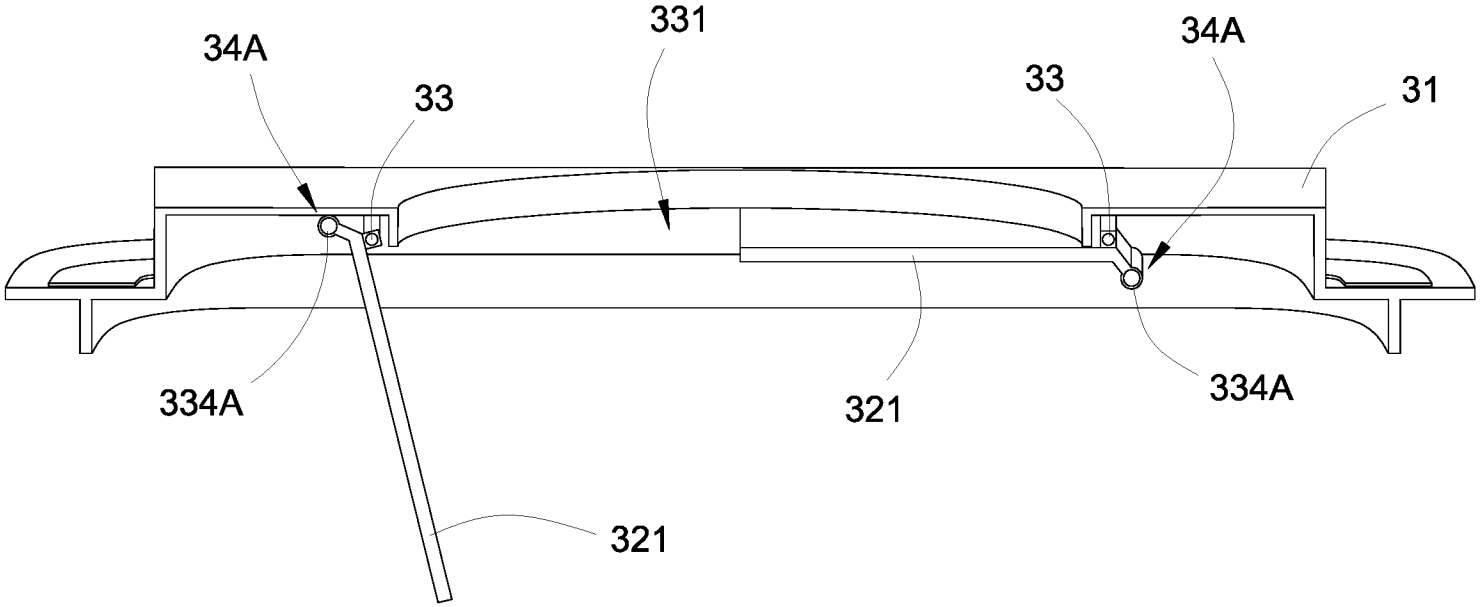
FIG. 6 illustrates an alternative mode of retention element of the internal shelter arrangement of the trash container according to the above preferred embodiment of the present invention.

FIG. 6 illustrates an alternative mode of retention element 334A for ensuring the shelter panel 321 being moved at the sealing position so as to ensure the shelter opening 311 being sealed by the shelter panel 321 when no external force is applied at the shelter panel 321. The retention element 334A comprises a weighting element coupled at the outer edge of each of the shelter panels 321 to apply a downward weighting force against the outer edge of the shelter panel 321 so as to upwardly push the inner edge of the shelter panel 321 to seal the shelter opening 311. Accordingly, the pivot joint 33 is coupled between the inner and outer edge of the shelter panel 321 to allow the pivot movement of the shelter panel 321, wherein the pivot joint 33 is located close to the outer edge of the shelter panel 321. In other words, a distance between the outer edge of the shelter panel 321 and the pivot joint 33 is shorter than a distance between the inner edge of the shelter panel 321 and the pivot joint 33. Furthermore, the shelter panel 321 has a L-shape defining a shorter panel portion between the outer edge of the shelter panel 321 and the pivot joint 33, and a longer panel portion between the inner edge of the shelter panel 321 and the pivot joint 33. Therefore, by adding a weight at the outer edge of the shelter panel 321 via the retention element 334A, the shelter panel 321 is pivotally folded at the sealing position when no external force is applied at the shelter panel 321. In other words, after the shelter panel 321 is pivotally moved at the unsealing position in response to the external force, the retention element 334A will apply a downward gravity force to upwardly move the inner edge of the shelter panel 321 back to its sealing position.

FIG. 6 further illustrates an alternative mode of the positioning member 34A provided at each of the shelter panel 321 for limiting a downward folding movement of the shelter panel 321. Accordingly, the positioning member 34A is built-in with the shelter panel 321, the outer edge of the shelter panel 321 serves as the positioning member 34A being pivotally and upwardly moved to bias against the bottom side of the shelter boundary frame 31 when the inner edge of the shelter panel 321 is downwardly folded so as to block a further pivot movement of the shelter panel 321.

It should be appreciated that the positioning member 34 can be built-in with the pivot joint 33 (not shown in the figures). For example, the positioning member 34 has a first blocking surface formed at the first joint body 332 and a second blocking surface formed at the second joint body 333, such that when the inner edge of said shelter panel 321 is pivotally and downwardly folded to open up the shelter opening 311, the second joint body 333 is rotated until the second blocking surface is biased against the first blocking surface so as to block a further pivot movement of the shelter panel 321.

As shown in FIGS. 1 and 2, the internal shelter arrangement 30 further comprises an attachment unit 35 for detachably attaching the shelter boundary frame 31 at the cover unit 20. In one embodiment, the attachment unit 35 comprise a ring shaped first magnetic element 351 formed on the shelter boundary frame 31 around the shelter opening 311, and one or more second magnetic attractable elements 352 provided at the cover unit 20 to magnetically attract with the first magnetic element 351 so as to detachably couple the shelter boundary frame 31 under the cover unit 20. Accordingly, the first magnetic element 351 is embodied as a magnetic strip overlapped on the upper surface of the shelter boundary frame 31. Correspondingly, the second magnetic attractable elements 352 are spacedly formed at the bottom surface of the cover housing 21 to align with the first magnetic element 351. When the shelter boundary frame 31 is coupled at the cover housing 21, the first and second magnetic attractable elements 351, 352 are magnetically attracted with each other to overlap the bottom surface of the cover housing 21 with the upper surface of the shelter boundary frame 31. Preferably, the second magnetic attractable elements 352 are embodied as the attachment screws 214, such that the first magnetic element 351 is magnetically attracted to the attachment screws 214 in order to couple the shelter boundary frame 31 at the cover housing 21. It should be appreciated that the second magnetic attractable elements 352 can be a plurality of magnets or magnetic discs spacedly formed at the bottom surface of the cover housing 21 to align with the first magnetic element 351. It should be appreciated that the second magnetic attractable elements 352 can be integrated to form a ring shaped magnet element having a size and shape corresponding to the first magnetic element 351, so as to magnetically attract the first and second magnetic attractable elements 351, 352 with each other.

Figure 7:
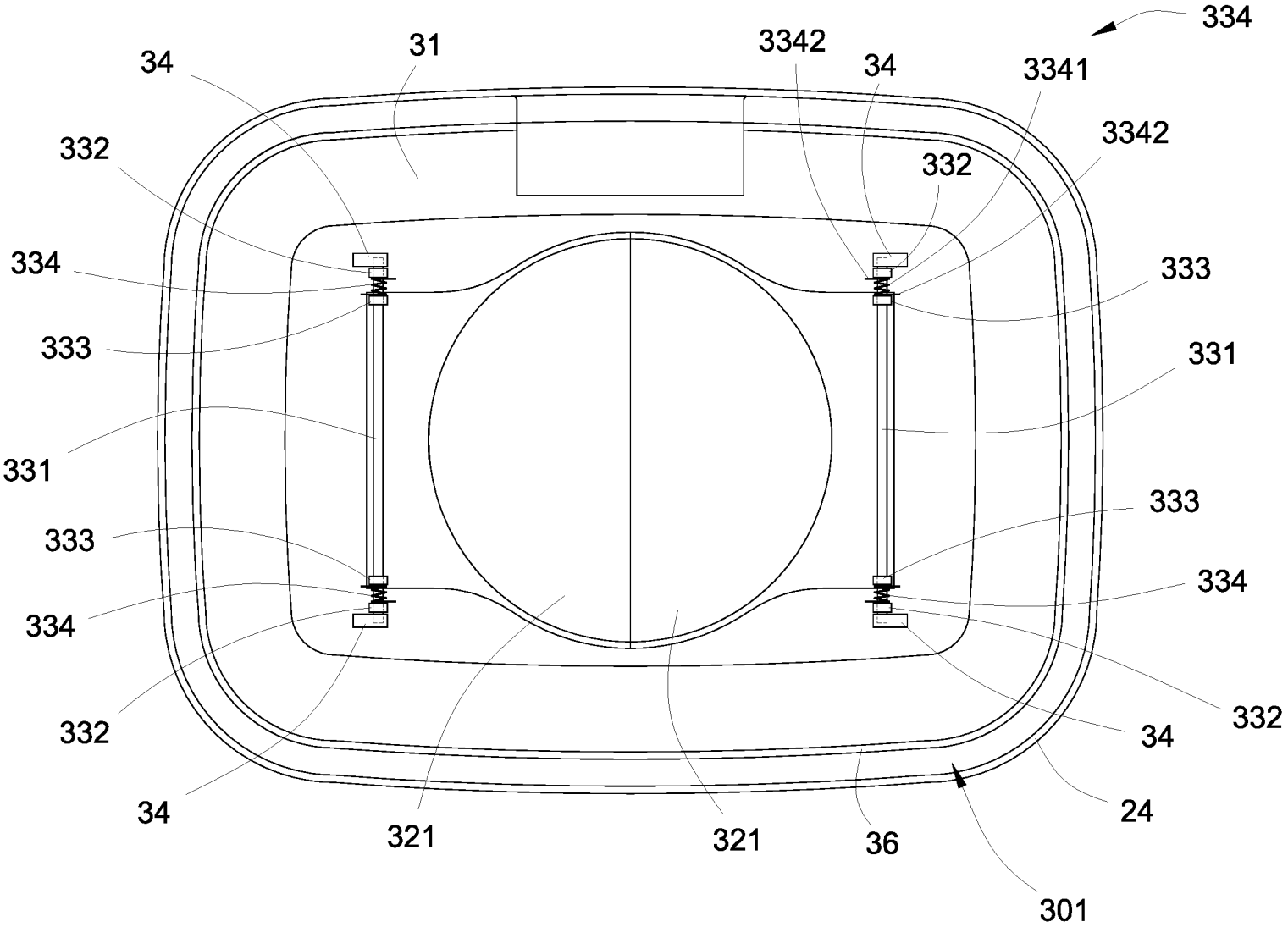
FIG. 7 is a bottom view of the internal shelter arrangement of the trash container according to the above preferred embodiment of the present invention, illustrating an edge receiving channel.

In order to stably support the cover unit 20 and the internal shelter arrangement 30 on top of the container body 10, the cover unit 20 further comprises an outer boundary rim 24 downwardly extended from a peripheral edge of the cover housing 21 for encircling around the opening edge of the top opening 11 of the container body 10 at an outer surface thereof. The internal shelter arrangement 30 further comprises an inner boundary rim 36 downwardly extended from a peripheral edge of the shelter boundary frame 31 for encircling around the opening edge of the top opening 11 of the container body 10 at an inner surface thereof. As shown in FIGS. 1 and 7, when the shelter boundary frame 31 is coupled at the cover unit 20, the inner boundary rim 36 is spacedly encircled within the outer boundary rim 24 to form an edge receiving channel 301 to receive the opening edge of the container body 10. In other words, each of the outer boundary rim 24 and the inner boundary rim 36 is shaped corresponding to the shape of the opening edge of the container body 10, wherein a size of the outer boundary rim 24 is larger than a size of the opening edge of the container body 10, while a size of the inner boundary rim 36 is smaller than a size of the opening edge of the container body 10. Therefore, when the cover unit 20 and the internal shelter arrangement 30 are rested on top of the container body 10, the opening edge of the container body 10 is received at the edge receiving channel 301 and is sandwiched between the outer boundary rim 24 and the inner boundary rim 36, such that the cover unit 20 and the internal shelter arrangement 30 can be coupled on top of the container body 10 in a stable manner.

According to the preferred embodiment, the internal shelter arrangement 30 can be incorporated with the existing trash can which comprises an upward folding cover panel. As it is mentioned above, the opening direction of the cover panel is opposite to the opening direction of the shelter unit 32, such that the internal shelter arrangement 30 can be an add-on component to the existing trash can because the operations of the cover panel and the internal shelter arrangement 30 are not interfere with each other.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An internal shelter arrangement for a trash container comprising a container body having a top opening for receiving a trash object through the top opening, and a cover unit being configured to couple on top of the container body and including at least a cover panel pivotally moved between an opened position for opening the top opening and a closed position for closing the top opening, wherein said internal shelter arrangement comprises:

a shelter boundary frame configured for detachably coupling between the container body and the cover unit, wherein said shelter boundary frame has a shelter opening configured for aligning with the top opening;

a shelter unit which comprises two shelter panels pivotally coupled at a bottom surface of said shelter boundary frame, wherein said shelter panels are upwardly and pivotally retained to bias against said bottom surface to seal said shelter opening so as for closing the top opening when the cover panel is either moved at the opened position or at the closed position, wherein said shelter panels are downwardly and pivotally folded to open up said shelter opening in response to an external force of a weight of a trash object for disposing the trash object in the container body when the top opening is opened up; and an attachment unit for detachably attaching said shelter boundary frame at the cover unit, wherein said attachment unit comprise a ring shaped first magnetic element formed on said shelter boundary frame around said shelter opening, and one or more second magnetic attractable elements provided for attaching to the cover unit for magnetically attracting with said first magnetic element so as for detachably coupling said shelter boundary frame under the cover unit.

2. The internal shelter arrangement, as recited in claim 1, wherein each of said shelter panels has an inner edge and an outer edge, wherein said inner edges of said shelter panels are aligned side-by-side to seal said shelter opening and are downwardly folded to open up said shelter opening, wherein each of said shelter panels has two sealing side edges biasing against a bottom surface of said shelter boundary frame to close said shelter opening when said shelter panel is pivotally and upwardly folded at said bottom surface of said shelter boundary frame.

3. The internal shelter arrangement, as recited in claim 2, wherein each of said shelter panels is pivotally coupled at said shelter boundary frame via a pivot joint which comprises one or more pivot shafts rotatably extended between said shelter panel and said shelter boundary frame, and one or more retention elements provided at said shelter panel to ensure said inner edges of said shelter panels are aligned side-by-side to seal said shelter opening when no external force is applied at said shelter panel, wherein said retention element comprises a resilient element coupled at said pivot shaft to apply a resilient force against said shelter panel so as to upwardly push said inner edge of said shelter panel to seal said shelter opening.

4. The internal shelter arrangement, as recited in claim 3, wherein said resilient element is a coil spring having a coil body coaxially coupled at said pivot shaft and two coil arms biasing against said shelter panel and said shelter boundary frame, wherein said pivot joint further comprises a first joint body formed at said shelter boundary frame and a second joint body formed at said shelter panel, wherein said pivot shaft is extended from said second joint body to rotatably couple with said first joint body.

5. The internal shelter arrangement, as recited in claim 4, wherein said internal shelter arrangement further comprises a positioning member provided at each of said shelter panels for limiting a downward folding movement of said shelter panel, wherein said positioning member, having a blocking surface, is coupled at a free end of said pivot shaft, such that when said pivot shaft is rotated to pivotally move said shelter panel sealing at said sheltering opening, said positioning member is driven to rotate until said blocking surface of said position member is biased against said bottom surface of said shelter boundary frame so as to block a further pivot movement of said shelter panel.

6. The internal shelter arrangement, as recited in claim 3, wherein said retention element comprises a weighting element coupled at said outer edge of each of said shelter panels to apply a downward weighting force against said outer edge of said shelter panel so as to upwardly push said inner edge of said shelter panel to seal said shelter opening, wherein a distance between said outer edge of said shelter panel and said pivot joint is shorter than a distance between said inner edge of said shelter panel and said pivot joint.

7. A trash container, comprising:

a container body having a top opening for receiving a trash object through said top opening;

a cover unit, coupled on top of said container body, including at least a cover panel pivotally moved between an opened position for opening said top opening and a closed position for closing said top opening, wherein said cover unit comprises a cover housing defining said top opening thereat, and an induction actuation unit disposed at said cover housing to actuate said cover panel in response to a presence of a user, such that said induction actuation unit is inducted to actuate said cover panel being upwardly and pivotally moved at said cover housing so as to open up said top opening thereof, and to actuate said cover panel being downwardly and pivotally moved at said cover housing so as to close said top opening thereof; and an internal shelter arrangement which comprises:

a shelter boundary frame coupled between said container body and said cover unit, wherein said shelter boundary frame has a shelter opening aligned with said top opening; and a shelter unit which comprises two shelter panels pivotally coupled at a bottom surface of said shelter boundary frame, wherein said shelter panels are upwardly and pivotally retained to bias against said bottom surface to seal said shelter opening so as for closing said top opening when said cover panel is either moved at said opened position or at said closed position, wherein said shelter panels are downwardly and pivotally folded to open up said shelter opening in response to an external force of a weight of a trash object for disposing the trash object in said container body when the top opening is opened up.

8. A trash container, comprising:

a container body having a top opening for receiving a trash object through said top opening;

a cover unit, coupled on top of said container body, including at least a cover panel pivotally moved between an opened position for opening said top opening and a closed position for closing said top opening wherein said cover unit further comprises a cover housing and an outer boundary rim downwardly extended from a peripheral edge of said cover housing; and an internal shelter arrangement which comprises:

a shelter boundary frame coupled between said container body and said cover unit, wherein said shelter boundary frame has a shelter opening aligned with said top opening;

a shelter unit which comprises two shelter panels pivotally coupled at a bottom surface of said shelter boundary frame, wherein said shelter panels are upwardly and pivotally retained to bias against said bottom surface to seal said shelter opening so as for closing said top opening when said cover panel is either moved at said opened position or at said closed position, wherein said shelter panels are downwardly and pivotally folded to open up said shelter opening in response to an external force of a weight of a trash object for disposing the trash object in said container body when the top opening is opened up; and an inner boundary rim downwardly extended from a peripheral edge of said shelter boundary frame, such that when said shelter boundary frame is coupled at said cover unit, said inner boundary rim is spacedly encircled within said outer boundary rim to form an edge receiving channel to receive an opening edge of said container body.

9. A trash container, comprising:

a container body having a top opening for receiving a trash object through said top opening;

a cover unit, coupled on top of said container body, including at least a cover panel pivotally moved between an opened position for opening said top opening and a closed position for closing said top opening, wherein said cover unit further comprises an outer boundary rim downwardly extended from a peripheral edge of said cover housing; and an internal shelter arrangement which comprises:

a shelter boundary frame coupled between said container body and said cover unit, wherein said shelter boundary frame has a shelter opening aligned with said top opening;

a shelter unit which comprises two shelter panels pivotally coupled at a bottom surface of said shelter boundary frame, wherein said shelter panels are upwardly and pivotally retained to bias against said bottom surface to seal said shelter opening so as for closing said top opening when said cover panel is either moved at said opened position or at said closed position, wherein said shelter panels are downwardly and pivotally folded to open up said shelter opening in response to an external force of a weight of a trash object for disposing the trash object in said container body when the top opening is opened up; and an inner boundary rim downwardly extended from a peripheral edge of said shelter boundary frame, such that when said shelter boundary frame is coupled at said cover unit, said inner boundary rim is spacedly encircled within said outer boundary rim to form an edge receiving channel to receive an opening edge of said container body.

10. A trash container, comprising:

a container body having a top opening for receiving a trash object through said top opening;

a cover unit, coupled on top of said container body, including at least a cover panel pivotally moved between an opened position for opening said top opening and a closed position for closing said top opening; and an internal shelter arrangement which comprises:

a shelter boundary frame coupled between said container body and said cover unit, wherein said shelter boundary frame has a shelter opening aligned with said top opening; and a shelter unit which comprises two shelter panels pivotally coupled at a bottom surface of said shelter boundary frame, wherein said shelter panels are upwardly and pivotally retained to bias against said bottom surface to seal said shelter opening so as for closing said top opening when said cover panel is either moved at said opened position or at said closed position, wherein said shelter panels are downwardly and pivotally folded to open up said shelter opening in response to an external force of a weight of a trash object for disposing the trash object in said container body when the top opening is opened up;

wherein each of said shelter panels has an inner edge and an outer edge, wherein said inner edges of said shelter panels are aligned side-by-side to seal said shelter opening and are downwardly folded to open up said shelter opening, wherein each of said shelter panels has two sealing side edges biasing against a bottom surface of said shelter boundary frame to close said shelter opening when said shelter panel is pivotally and upwardly folded at said bottom surface of said shelter boundary frame;

wherein each of said shelter panels is pivotally coupled at said shelter boundary frame via a pivot joint which comprises one or more pivot shafts rotatably extended between said shelter panel and said shelter boundary frame, and one or more retention elements provided at said shelter panel to ensure said inner edges of said shelter panels are aligned side-by-side to seal said shelter opening when no external force is applied at said shelter panel, wherein said retention element comprises a resilient element coupled at said pivot shaft to apply a resilient force against said shelter panel so as to upwardly push said inner edge of said shelter panel to seal said shelter opening;

wherein said retention element comprises a weighting element coupled at said outer edge of each of said shelter panels to apply a downward weighting force against said outer edge of said shelter panel so as to upwardly push said inner edge of said shelter panel to seal said shelter opening, wherein a distance between said outer edge of said shelter panel and said pivot joint is shorter than a distance between said inner edge of said shelter panel and said pivot joint.

11. An internal shelter arrangement for a trash container comprising a container body having a top opening for receiving a trash object through the top opening, and a cover unit being configured to couple on top of the container body and including at least a cover panel pivotally moved between an opened position for opening the top opening and a closed position for closing the top opening, wherein said internal shelter arrangement comprises:

a shelter boundary frame configured for detachably coupling between the container body and the cover unit, wherein said shelter boundary frame has a shelter opening configured for aligning with the top opening; and a shelter unit which comprises two shelter panels pivotally coupled at a bottom surface of said shelter boundary frame, wherein said shelter panels are upwardly and pivotally retained to bias against said bottom surface to seal said shelter opening so as for closing the top opening when the cover panel is either moved at the opened position or at the closed position, wherein said shelter panels are downwardly and pivotally folded to open up said shelter opening in response to an external force of a weight of a trash object for disposing the trash object in the container body when the top opening is opened up, wherein each of said shelter panels has an inner edge and an outer edge, wherein said inner edges of said shelter panels are aligned side-by-side to seal said shelter opening and are downwardly folded to open up said shelter opening, wherein each of said shelter panels has two sealing side edges biasing against a bottom surface of said shelter boundary frame to close said shelter opening when said shelter panel is pivotally and upwardly folded at said bottom surface of said shelter boundary frame, wherein each of said shelter panels is pivotally coupled at said shelter boundary frame via a pivot joint which comprises one or more pivot shafts rotatably extended between said shelter panel and said shelter boundary frame, and one or more retention elements provided at said shelter panel to ensure said inner edges of said shelter panels are aligned side-by-side to seal said shelter opening when no external force is applied at said shelter panel, wherein said retention element comprises a resilient element coupled at said pivot shaft to apply a resilient force against said shelter panel so as to upwardly push said inner edge of said shelter panel to seal said shelter opening, wherein said retention element comprises a weighting element coupled at said outer edge of each of said shelter panels to apply a downward weighting force against said outer edge of said shelter panel so as to upwardly push said inner edge of said shelter panel to seal said shelter opening.

12. The internal shelter arrangement, as recited in claim 11, wherein a distance between said outer edge of said shelter panel and said pivot joint is shorter than a distance between said inner edge of said shelter panel and said pivot joint.

* * * * *